US008851412B2

(12) United States Patent
Tenpaku et al.

(10) Patent No.: US 8,851,412 B2
(45) **Date of Patent: *Oct. 7, 2014**

(54) RECORDING APPARATUS AND ROLL MEDIUM LIFTING DEVICE

(75) Inventors: Hisashi Tenpaku, Matsumoto (JP); Masaki Kobayashi, Shiojiri (JP); Seijun Horie, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 160 days.

This patent is subject to a terminal disclaimer.

(21) Appl. No.: 13/347,826

(22) Filed: Jan. 11, 2012

(65) Prior Publication Data

US 2012/0187233 A1 Jul. 26, 2012

(30) Foreign Application Priority Data

Jan. 24, 2011 (JP) ..... 2011-012131

(51) Int. Cl.
*B65H 19/22* (2006.01)

(52) U.S. Cl.
USPC ..... 242/533; 242/559.4

(58) Field of Classification Search
USPC ..... 242/533, 588, 559, 559.3, 559.4, 561, 242/557
See application file for complete search history.

(56) References Cited

U.S. PATENT DOCUMENTS

| | | | | |
|---|---|---|---|---|
| 3,325,120 | A * | 6/1967 | Brinkman | 242/557 |
| 4,154,470 | A | 5/1979 | Daglish | |
| 4,824,313 | A * | 4/1989 | Miller | 414/346 |
| 5,253,972 | A * | 10/1993 | Drew et al. | 414/469 |
| 5,524,415 | A * | 6/1996 | Pachinger et al. | 53/203 |
| 6,299,100 | B1 * | 10/2001 | Cloud | 242/598.5 |
| 7,360,740 | B2 * | 4/2008 | Reagan et al. | 242/596.1 |
| 2004/0011914 | A1 | 1/2004 | Gandini | |
| 2009/0104007 | A1 | 4/2009 | Umezawa et al. | |
| 2009/0242603 | A1 | 10/2009 | Kobayashi et al. | |
| 2012/0091250 | A1 * | 4/2012 | Tenpaku et al. | 242/596 |
| 2012/0187233 | A1 * | 7/2012 | Tenpaku et al. | 242/590 |
| 2013/0043340 | A1 | 2/2013 | Tenpaku et al. | |

FOREIGN PATENT DOCUMENTS

| | | | |
|---|---|---|---|
| CN | 101412490 | B | 4/2009 |
| GB | 2175572 | A | 12/1986 |
| JP | 6-340357 | A | 12/1994 |
| JP | 2004-509036 | A | 3/2004 |
| JP | 2006-229469 | | 8/2006 |
| JP | 2009-023171 | | 2/2009 |
| JP | 2009-234668 | | 10/2009 |

OTHER PUBLICATIONS

U.S. Appl. No. 13/252,607, Jul. 24, 2013, Office Action.
U.S. Appl. No. 13/252,607, Nov. 12, 2013, Final Office Action.
U.S. Appl. No. 13/252,607, Mar. 28, 2014, Notice of Allowance.
U.S. Appl. No. 13/565,894, Apr. 21, 2014, Office Action.

* cited by examiner

*Primary Examiner* — Sang Kim
(74) *Attorney, Agent, or Firm* — Workman Nydegger

(57) ABSTRACT

A roll medium lifting device of a recording apparatus includes: an elevating unit that has a loading unit therein and can be raised and lowered in the vertical direction; an operation lever that is rotatable about a fulcrum; and a cam that performs force transmission by converting rotational movement of the operation lever in the vertical direction to vertical movement of the elevating unit at a position closer to the fulcrum in the operation lever. Further, when the operation lever is rotated to cause the cam to move the elevating unit upward, a portion of the cam that makes contact with the elevating unit faces to the moving direction when the elevating unit is moved upward.

8 Claims, 9 Drawing Sheets

RECORDING APPARATUS AND ROLL MEDIUM LIFTING DEVICE

BACKGROUND

This application claims priority to Japanese Patent Application No. 2011-012131, filed Jan. 24, 2011 which application is expressly incorporated herein by reference.

TECHNICAL FIELD

The present invention relates to a recording apparatus that includes a roll medium holder equipped with a shaft which holds a roll medium in a feedable manner and a temporary placement unit on which the roll medium is temporarily placed before the roll medium is mounted on the roll medium holder, and also relates to a roll medium lifting device.

RELATED ART

In this specification, the recording apparatus includes various types of apparatuses such as an ink jet printer, a wire dot printer, a laser printer, a line printer, a copying machine, a fax machine, and so on.

A recording apparatus such as a large-size ink jet printer or the like is configured so that roll paper is temporarily placed on a temporary placement table and then mounted on a roll paper holder that is attached to the recording apparatus, as described in JP-A-2009-23171, because the roll paper is heavy in weight.

In the past technique, the roll paper is at first placed on a temporary placement table, a user lifts the roll paper approximately 2 to 5 cm by hand up to the height of the shaft of a roll paper holder so as to align the position of the core hole of the roll core of the roll paper and the position of the shaft, then the roll paper holder is slid horizontally in the axial direction so that the shaft is inserted into the core hole.

However, at present, roll paper normally weighs 20 to 30 kg, and further weighs 40 to 50 kg in some cases. With such increasing tendency in weight of the roll paper, a problem has prominently arisen such that it consequently imposes heavy work on a user as making the user lift up the roll paper by hand.

SUMMARY

An advantage of some aspects of the invention is to provide a recording apparatus in which a user can mount a roll medium on a roll medium holder without heavy work even in a case where the roll paper is heavy in weight while in accordance with the increasing tendency in weight of the roll paper, and a roll medium lifting device.

In order to achieve the above advantage, a recording apparatus according to a first aspect of the invention includes: a roll medium holder having a shaft that holds a roll medium in a feedable manner; a temporary placement unit on which the roll medium is temporarily placed; and a roll medium lifting device that has a loading unit onto which the roll medium is loaded, and loads an end portion of the roll medium, which has been temporarily placed as described above, onto the loading unit and then lifts the roll medium up to the height of the shaft of the roll medium holder so as to align the position of the core hole of the roll core of the roll medium and the position of the shaft. Further, the roll medium lifting device includes: an elevating unit that has the loading unit therein and can be raised and lowered in the vertical direction; an operation lever that is rotatable about a fulcrum; and a cam that performs force transmission by converting the rotational movement of the operation lever in the vertical direction to the vertical movement of the elevating unit at a position closer to the fulcrum in the operation lever. Furthermore, when the operation lever is rotated to cause the cam to move the elevating unit upward, a portion of the cam that makes contact with the elevating unit faces to the moving direction when the elevating unit is moved upward.

Note that "a portion of the cam that makes contact with the elevating unit faces to the moving direction when the elevating unit is moved upward" does not mean that the direction to which the contact portion faces is required to be strictly the same as the direction of movement of the elevating unit, but means that the direction to which the contact portion faces can have an error in direction and is acceptable if it is approximately the same as the direction of movement of the elevating unit.

According to this aspect, it is possible to lift up a roll medium from a temporary placement unit to the height of the shaft of a roll medium holder without heavy work by using a roll medium lifting device equipped with a loading unit onto which the roll medium is loaded. In contrast, in the past technique, the user was requested to lift up the roll medium to the height of the shaft of the roll medium holder by hand.

In addition, it is possible to lift up the roll medium with a relatively small force due to the principle of leverage.

Further, the contact portion mentioned above faces to the moving direction when the elevating unit is moved upward. Here, a large force from the cam is exerted on the elevating unit in the normal direction of the contact portion. Accordingly, a large force is exerted on the elevating unit in the upwardly moving direction. On the other hand, a force in the lateral direction, with respect to the vertical direction, is hardly exerted on the elevating unit. Accordingly, in the roll medium lifting device, it is possible to cause the friction force between the members other than the elevating unit and the cam, and the elevating unit to be nearly zero. As a result, it is easy to lift up the roll medium because of the efficient force transmission when lifting the elevating unit.

According to a second aspect of the invention, it is preferable that, in the apparatus according to the first aspect, the portion of the cam that makes contact with the elevating unit be so configured as to face to the movement direction of the elevating unit when the elevating unit is moved upward from the time when the operation lever is rotated so as to make the cam start lifting the elevating unit upward until the time when the rotation of the operation lever is stopped so as to stop the upward movement of the elevating unit.

According to this aspect, the same action effect can be obtained as the one in the first aspect, and in addition, the efficiency of force transmission when lifting the elevating unit can be further improved.

According to a third aspect of the invention, it is preferable that, in the apparatus according to any one of the first and second aspects, the elevating unit include a face that is orthogonal to the movement direction and makes contact with the cam, the cam have a curved surface that curves in a convex manner, and a portion of the elevating unit that makes contact with the cam be so configured as not to move when the elevating unit is moved.

According to this aspect, the contact portion can be so configured as to face to the movement direction of the elevating unit with ease when the elevating unit is moved upward.

Further, by causing the portion of the elevating unit that makes contact with the cam not to move, it is possible to make a portion of the elevating unit which receives the force from the cam be constant. As a result, the posture of the elevating unit can be stabilized.

According to a fourth aspect of the invention, it is preferable that the apparatus according to any one of the first through third aspects be so configured as to generate a gap between the elevating unit and a base unit of the roll medium lifting device when the elevating unit is moved upward, and further include a cover member that covers the gap by making contact with the elevating unit on the way of the elevating unit moving upward and thereafter moving upward together with the elevating unit.

According to this aspect, the same action effect can be obtained as the one in any one of the first through third aspects, and in addition, it is possible to prevent a finger, an object or the like from being caught in the gap, that is, a safety measure is provided. In the case where the roll medium is heavy in weight, for example, weighing around 60 kg, there exists a risk that an accident may happen if a finger is carelessly got caught in the gap. Therefore, the configuration of this aspect is particularly effective in such case.

According to a fifth aspect of the invention, it is preferable that, in the apparatus according to any one of the first through fourth aspects, the temporary placement unit include at least two bar members provided in parallel to each other along the width direction of the roll medium, the base unit of the roll medium lifting device be slidably attached to the bar members and configured so as to place temporarily an end portion of the roll medium thereon, a hole be provided in the operation lever, one of the bar members be inserted into the hole, the two bar members be inserted into the base unit, and the base unit make contact with the operation lever at both sides in the axial direction of rotation of the operation lever and be so configured as to hold the elevating unit in a slidable manner in the vertical direction.

According to this aspect, the same action effect can be obtained as the one in any one of the first through fourth aspects, and in addition, the roll medium lifting device can be configured so as not to use a screw therein. Therefore, it is easy to assemble the roll medium lifting device. Furthermore, according to this aspect, there exhibits excellence in cost reduction and smart appearance in the device.

According to a sixth aspect of the invention, it is preferable that, in the apparatus according to any one of the first through fifth aspects, the loading unit in the elevating unit have two sides that make contact with the roll medium loaded onto the loading unit when viewed from the axial direction of rotation of the operation lever, and the distance between the two sides become shorter as they proceed downward.

According to this aspect, the same action effect can be obtained as the one in any one of the first through fifth aspects, and in addition, the roll medium can be prevented from being unsteady when it is loaded onto the loading unit. Accordingly, the position of the roll medium can be stabilized when the roll medium is loaded thereon.

A seventh aspect of the invention is the roll medium lifting device that has been described in any one of the first through sixth aspects.

It is to be noted that the roll medium lifting device of the invention is not limited to the roll medium lifting device used in the recording apparatus.

In the roll medium lifting device according to this aspect, the same action effect can be obtained as the one described in each of the aforementioned aspects.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described with reference to the drawings.

Figure 1:
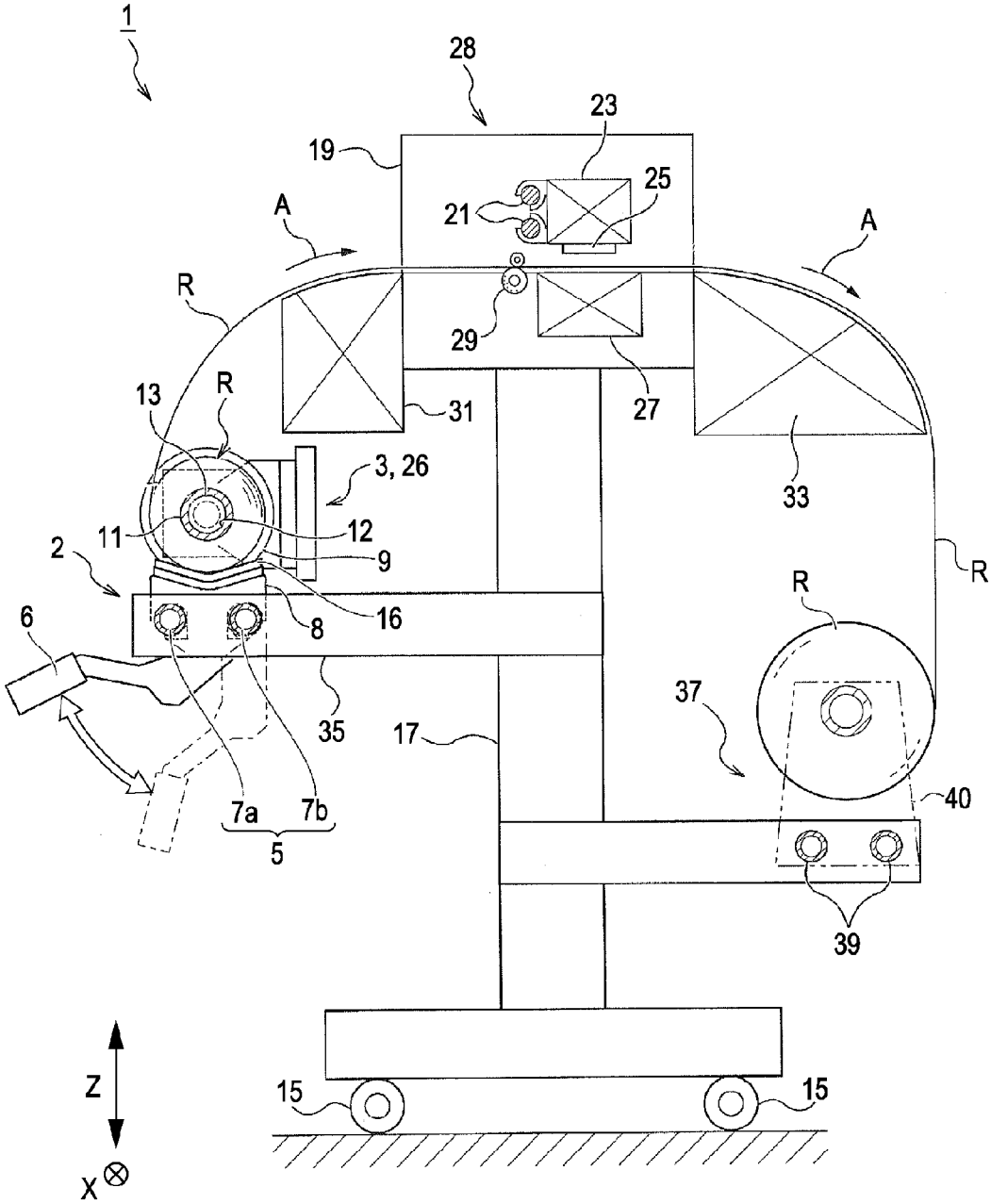
FIG. 1 is a side cross-section view schematically illustrating the overall configuration of a printer according to an embodiment of the invention.

FIG. 1 is a side cross-section view schematically illustrating the overall configuration of a large-size ink jet printer 1 (hereinafter, simply called a printer) as a recording apparatus according to an embodiment of the invention.

As shown in FIG. 1, the printer 1 includes a medium transport unit 26, a recording unit 28, and a winding unit 37. The medium transport unit 26 is so configured as to unwind a roll medium R that has been wound in a roll state and transport it in a transport direction A. To be more specific, the medium transport unit 26 includes a first holder unit 3 and a pair of rollers 29.

The first holder unit 3 is provided so as to hold both end portions of the roll medium R in a rotatable manner. Further, the first holder unit 3 includes a shaft 13 that is fitted into a core hole 12 of a roll core 11 of the roll medium R and a flange 9 that can make contact with the end portion of the roll medium R. The shaft 13 can take either a configuration in which it can freely rotate or a configuration in which it is driven by the driving force given by a motor (not shown). Note that in the configuration in which the shaft 13 can freely rotate, the roll medium R is pulled and unwound by the pair of rollers 29 driving at the downstream side in the transport direction.

The first holder units 3 are disposed in pairs opposing each other. Further, at least one of the first holder units 3 can be slid in a width direction X so as to adjust the attachment position thereof in accordance with the difference in width dimension of the roll medium.

On the lower side of the first holder unit 3, a temporary placement table 5 as a temporary placement unit and a lifting device 2 as a lifting unit, which will be later explained in detail, are provided. Here, briefly speaking, the temporary placement table 5 is a table on which the roll medium R is temporarily placed before it is attached to the first holder unit 3. For example, the temporary placement table 5 is configured of two bar members 7*a*, 7*b* that are provided extending in the width direction X. The lifting device 2 is so configured as to easily lift up the roll medium R, which is heavy in weight and is placed on the temporary placement table 5, and attach a side end of the roll medium R to the first holder unit 3 with ease.

More specifically, the lifting device 2 is equipped with a base unit 8 that can slidably move in the width direction X with respect to the two bar members 7*a* and 7*b*, an operation lever 6, and an elevating unit 16. When the operation lever 6 is rotated in one direction, the elevating unit 16 is raised so as to lift the roll medium R upward. On the other hand, when the operation lever 6 is rotated in the opposite direction, the elevating unit 16 is lowered so as to bring down the roll medium R.

The recording unit 28 includes a main printer body 19. Carriage guide shafts 21 extending in the width direction X, a carriage 23, a recording head 25, and a medium support unit 27 are provided in the main printer body 19. The carriage 23 is so provided as to move in the width direction X while being guided by the carriage guide shafts 21. The recording head 25 is provided on the carriage 23 at a position opposing the medium support unit 27, and configured so as to perform recording by discharging ink on to the roll medium R. In addition, the medium support unit 27 is so provided as to support the roll medium R and maintain the distance between the roll medium R and the recording head 25 at a predetermined length.

Although the pair of rollers 29 is provided inside of the main printer body 19, it may be provided outside thereof. This is because what is needed here is to transport the roll medium R in the transport direction A.

A pre-heater 31 is provided on the upstream side in the transport direction from the main printer body 19. The pre-heater 31 heats the roll medium R beforehand at a stage before recording is performed on the roll medium R so that the ink which lands on the roll medium R is easily dried when the recording is performed.

Furthermore, an after-heater 33 is provided on the downstream side in the transport direction from the main printer body 19. The after-heater 33 is expected to surely dry the ink having landed on the roll medium R in a period of time after the recording has been performed and just before the roll medium R is wound by the winding unit 37.

The winding unit 37 is so configured as to wind the roll medium R using driving force and hold the wound roll media R with a second holder unit 40 that is attached to two bar members 39.

It is to be noted that the printer 1 includes support frames 17, which are formed in an inverted T-shape when viewed from the side and have casters 15 for movement at the lower end portion, that are disposed opposing each other at left and right end portions thereof. The main printer body 19 is arranged on the upper portion of the support frames 17. The temporary placement table 5 is attached to a sub-frame 35 that is fixed to the support frame 17.

Next, the lifting device 2 of this embodiment will be described in detail.

Figure 2:
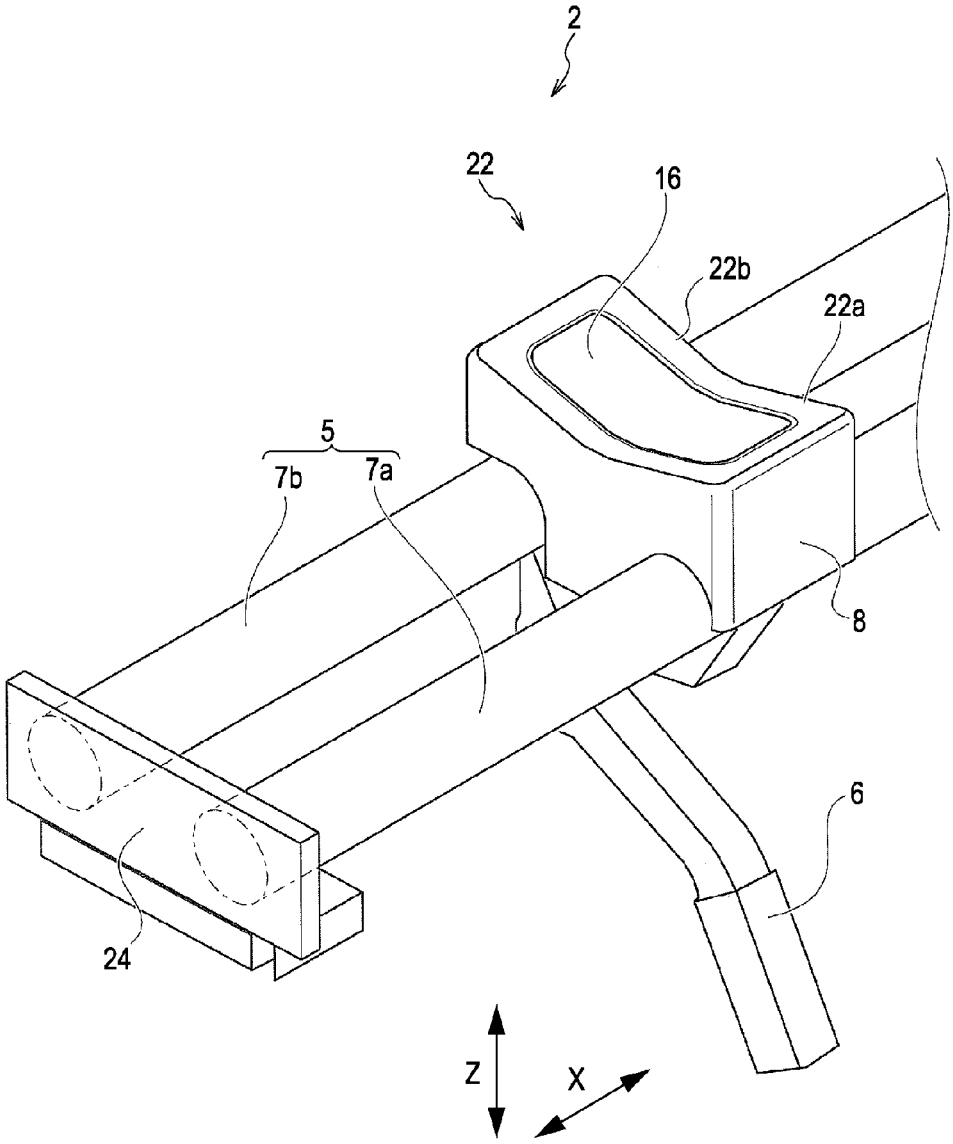
FIG. 2 is a perspective view illustrating a lifting device according to an embodiment of the invention.

FIG. 2 is a perspective view illustrating the lifting device 2 of the embodiment. Since the lifting device 2 is provided with a pair of structures of the same configuration under the vicinity of each end of the roll medium R, only one of them is illustrated in the drawings.

As shown in FIG. 2, end portions of the bar members 7*a*, 7*b* are sustained by a bar sustainer 24 that is attached to the sub-frame 35. And the lifting device 2 is installed on the bar members 7*a*, 7*b*. The lifting device 2 includes the base unit 8, the elevating unit 16 and the operation lever 6.

The base unit 8 is so installed as to be slidably movable with respect to the two bar members 7*a*, 7*b*.

The elevating unit 16 is so installed as to be slidably movable in the vertical direction Z with respect to the base unit 8. Further, on the upper sides of the base unit 8 and the elevating unit 16, the loading unit 22 onto which the roll medium R is loaded is provided. In the configuration of the embodiment, the upper side of the base unit 8 and the upper side of the elevating unit 16 are at the same height in a state in which the elevating unit 16 is lowered.

It may be advisable that the loading unit 22 is configured only by the upper side of the elevating unit 16 because the same action effect can be obtained thereby.

Furthermore, both end sides of the loading unit 22 are formed higher than the center portion thereof when viewed from the axial direction (X) of the bar members 7*a*, 7*b*. To rephrase, the upper surface of the loading unit 22 is formed so that two upper sides 22*a*, 22*b* that make contact with the roll medium R have a V-shaped look. Accordingly, when the roll medium R is loaded onto the loading unit 22, the roll medium R can be prevented from rolling so as to stabilize the position of the roll medium R. From an engineering standpoint, the two upper sides 22*a*, 22*b* are not necessarily required to be V-shaped; that is, it is sufficient that the two upper sides 22*a*, 22*b* are provided so that the distance between the two upper sides 22*a*, 22*b* becomes shorter as they proceed downward when viewed from the axial direction (X), and are configured so that the two sides 22*a*, 22*b* make contact with the outer periphery of the roll medium R.

It is needless to say that the loading unit 22 may be formed so that the upper surface thereof has a U-shaped look when viewed from the axial direction (X) of the bar members 7*a*, 7*b*.

The operation lever 6 is so provided as to be rotatable about a single bar member 7*b* as a rotation axis. Further, through the principle of leverage, as will be described later in detail, the embodiment is configured so that the elevating unit 16 can be moved upward with a small force.

Subsequently, an assembly method of the lifting device 2 will be described below.

Figure 3A:
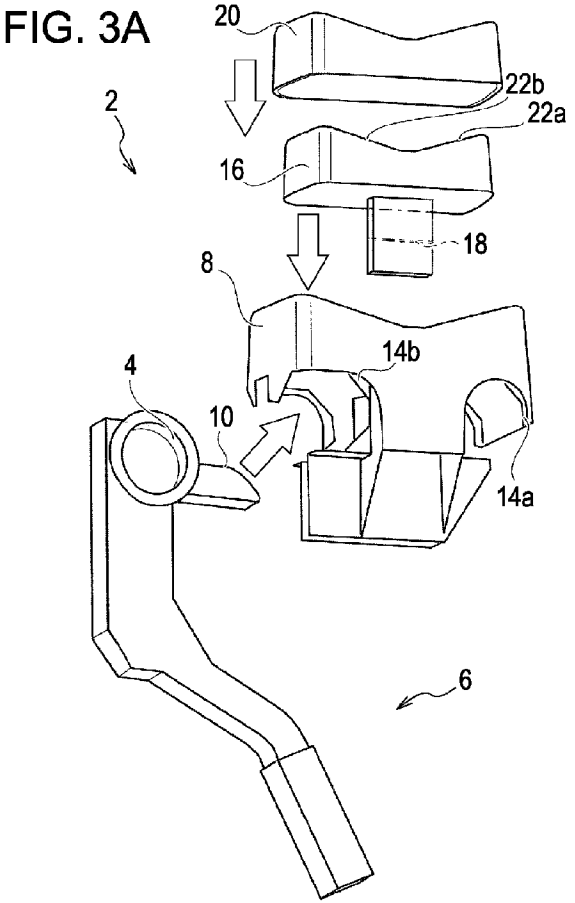
FIGS. 3A through 3C are perspective views illustrating an assembly method of a lifting device according to an embodiment of the invention.
Figure 3B:
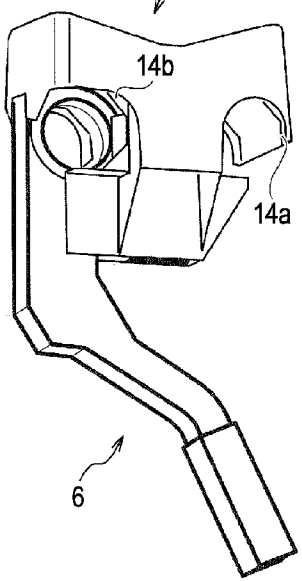
Figure 3C:
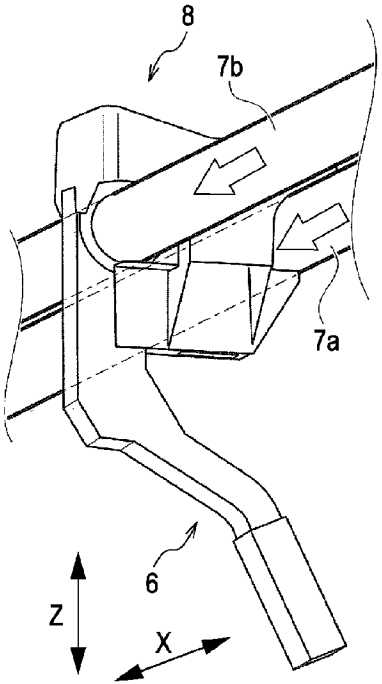

FIGS. 3A through 3C are perspective views illustrating the assembly method of the lifting device 2 according to the embodiment.

As shown in FIG. 3A, the operation lever 6 is provided with a hole 4 and a cam 10. The operation lever 6 is attached to the base unit 8 so that the cam 10 enters the inside of the base unit 8. The elevating unit 16 is covered with a cover member 20 from above. Further, the cover member 20 and the elevating unit 16 are attached to the base unit 8 from above so that a cam follower 18 provided on the elevating unit 16 enters the inside of the base unit 8 to make contact with the cam 10.

Then, the device comes into the state as illustrated in FIG. 3B. At this time, the hole 4 in the operation lever 6 can be seen through an insertion portion 14*b* of the base unit 8. The operation lever 6 is in a state of being pinched in the base unit 8.

Subsequently, as illustrated in FIG. 3C, the two bar members 7*a*, 7*b* are inserted into two insertion portions 14*a* and 14*b* of the base unit 8, respectively. At this time, the single bar member 7*b* is inserted into the hole 4 in the operation lever 6. The operation lever 6 is capable of rotating about this bar member 7*b* as a rotation axis. It is possible to move the entire lifting device 2 in the width direction X of the roll medium R to which the bar members 7*a*, 7*b* are extended, by moving the base unit 8 in a sliding manner with respect to the two bar members 7*a*, 7*b*.

The lifting device 2 can be easily assembled as described above without using a screw.

Next, operation of the lifting device 2 is described below.

Figure 4:
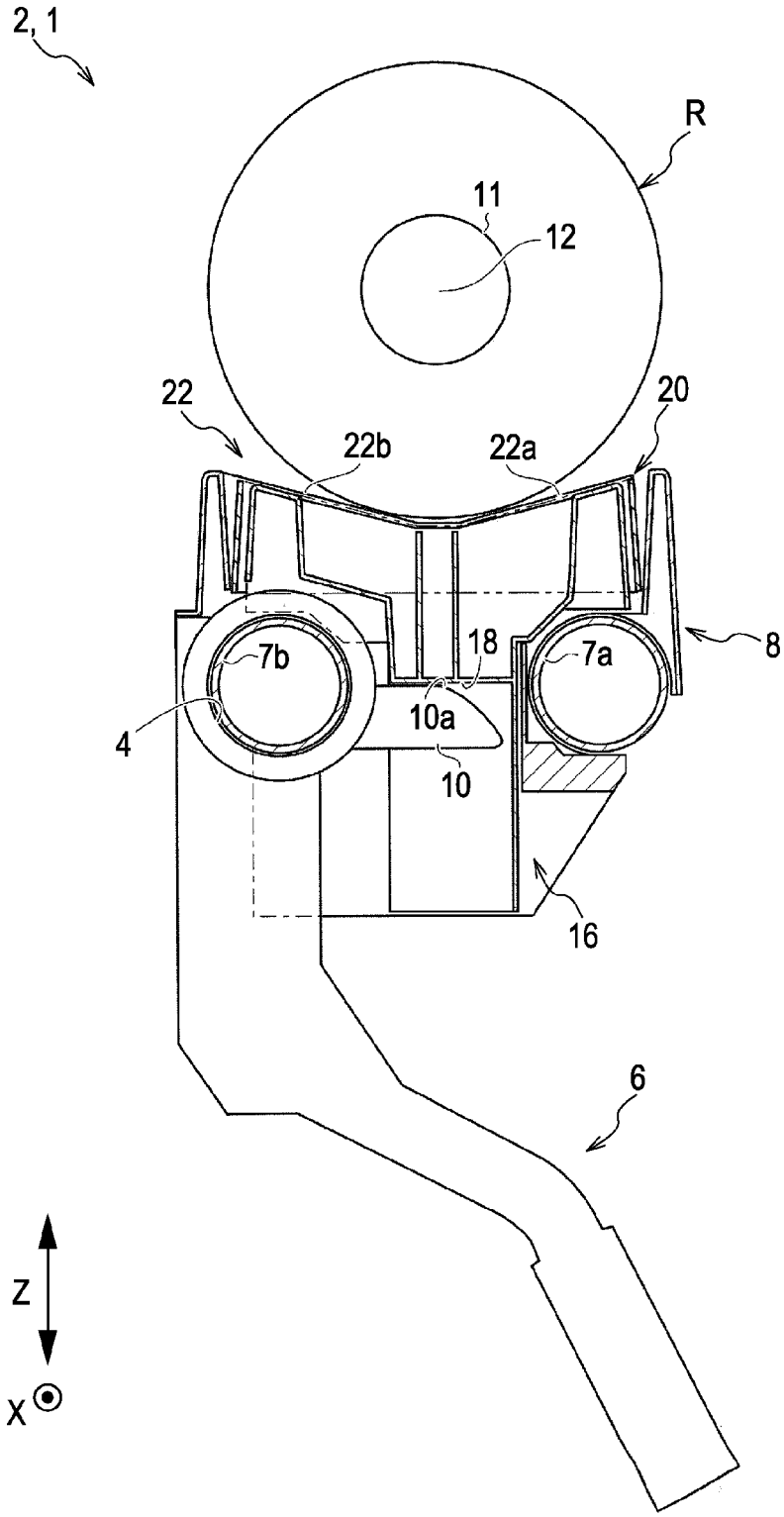
FIG. 4 is a side cross-section view illustrating operation of a lifting device according to an embodiment of the invention (before lifting).

FIG. 4 is a side cross-section view of the lifting device 2 indicating a state in which the roll medium R is placed on the loading unit 22 before being lifted up. Meanwhile, FIG. 5 is an elevation view of the lifting device 2 in the state as illustrated in FIG. 4.

Figure 5:
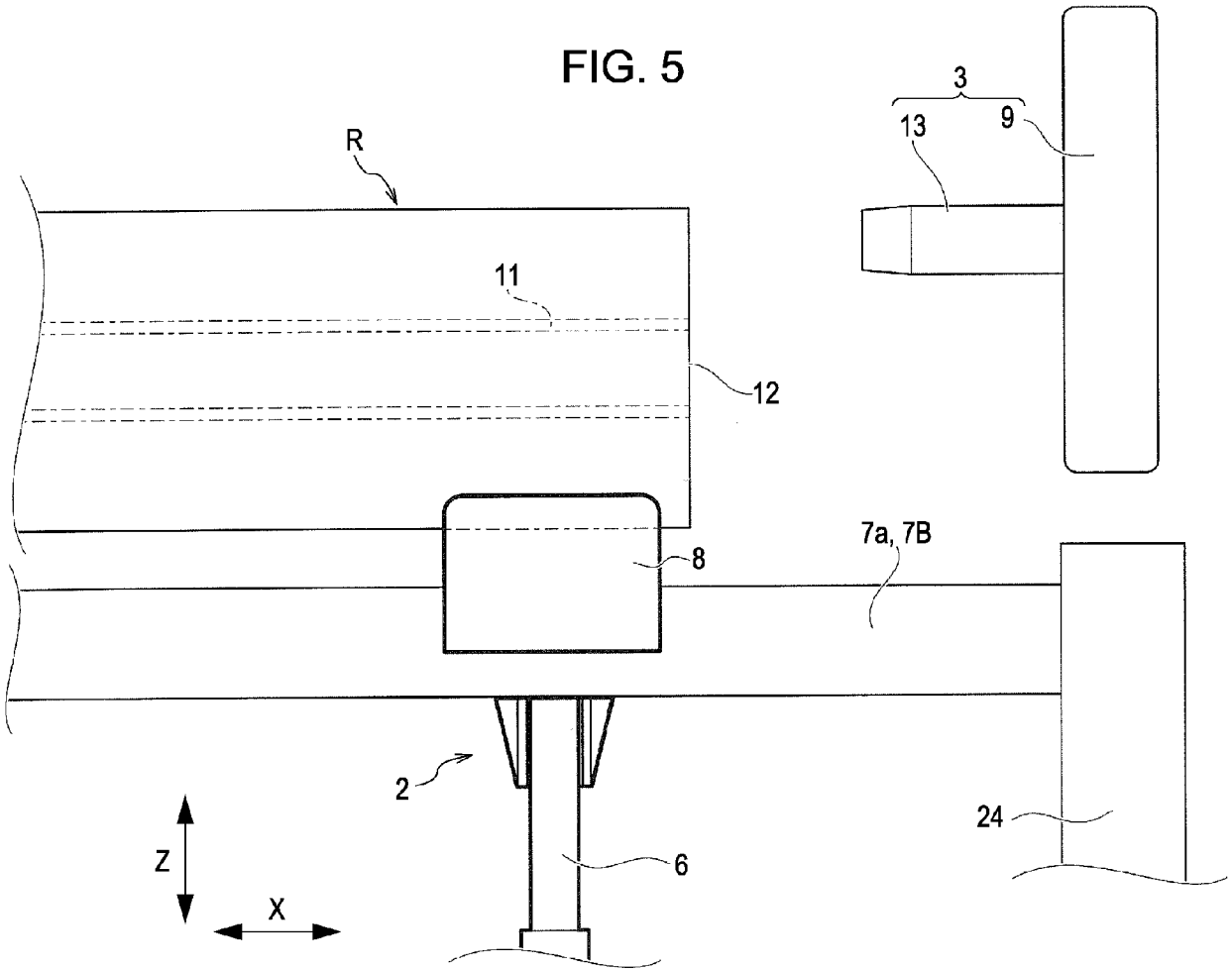
FIG. 5 is an elevation view of the lifting device in the state as illustrated in FIG. 4.

As shown in FIGS. 4 and 5, the roll medium R is placed on the loading unit 22 of the lifting device 2.

At this time, in the case where the position of the upper surface of the loading unit 22 is higher than the position of the temporary placement table 5 configured by the two bar members 7*a*, 7*b* as in the configuration of this embodiment, a pair of the lifting devices 2 is separately slid toward both sides and then the roll medium R is once placed on the temporary placement table 5.

Subsequently, the roll medium R having been placed on the temporary placement table 5 is loaded onto the loading unit 22 of the lifting device 2. The roll medium R is loaded thereon in the following manner: a user lifts up one end side of the roll medium R and slides one of the pair of lifting devices 2 to the vicinity under the one end; then loads the one end side of the roll medium R onto the loading unit 22 of the one of the pair of lifting devices 2. Similarly, the user lifts up the other end side of the roll medium R and slides the other of the pair of lifting devices 2 to the vicinity under the other end; then loads the other end side of the roll medium R onto the loading unit 22 of the other of the pair of lifting devices 2.

It may be advisable that the position of the upper surface of the loading unit 22 is lower than the position of the temporary placement table 5 configured by the two bar members 7*a*, 7*b*. In such a configuration, the roll medium R is at first placed on the temporary placement table 5. And, it is sufficient that the pair of lifting devices 2 is only slid to come to the vicinities of both ends of the roll medium R.

In the case where the position of the upper surface of the loading unit 22 is higher than the position of the temporary placement table 5 configured by the two bar members 7*a*, 7*b*, it is needless to say that the loading unit 22 can be used as the temporary placement unit (the temporary placement table 5).

Figure 6:
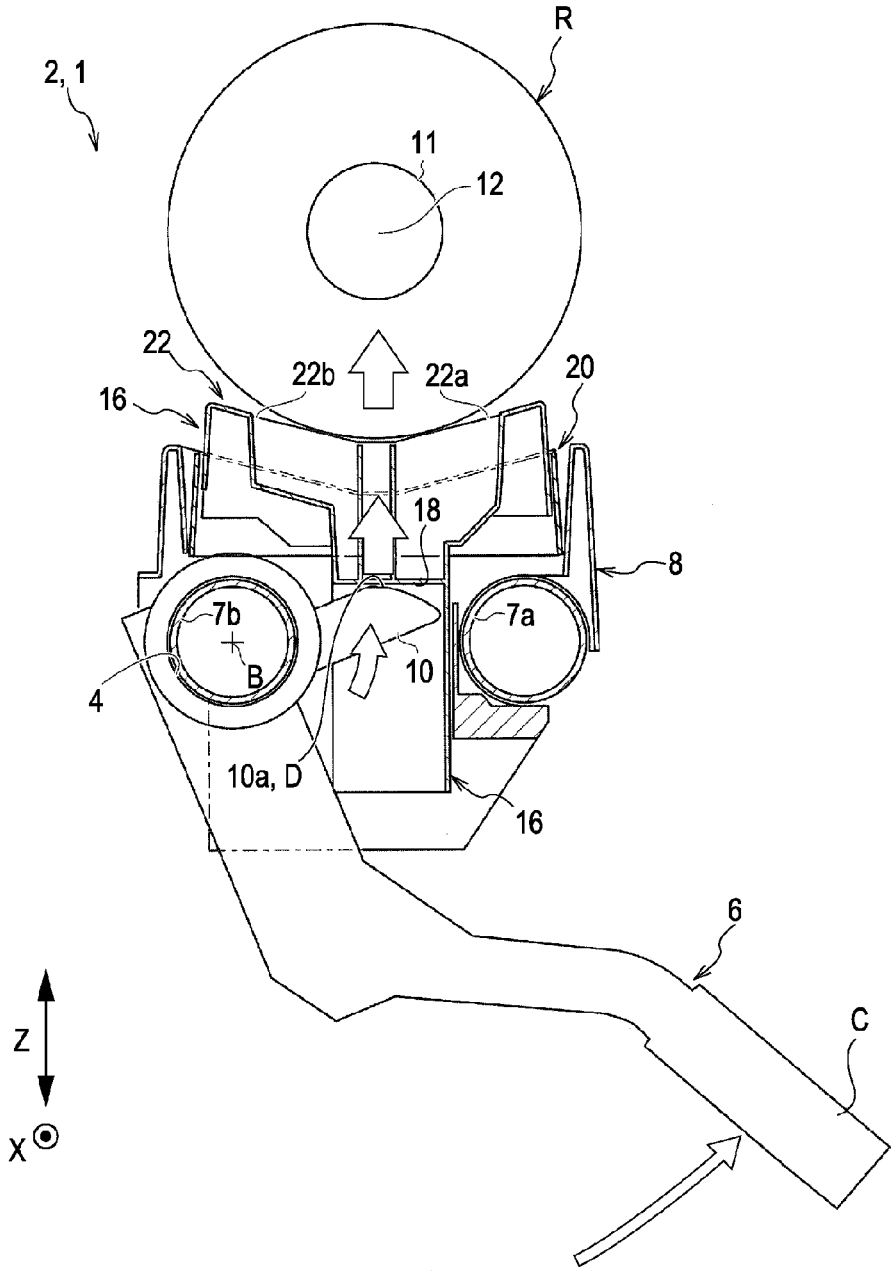
FIG. 6 is a side cross-section view illustrating operation of a lifting device according to an embodiment of the invention (during lifting).

FIG. 6 is a side cross-section view illustrating the operation of lifting during the process of the lifting device 2 according to the embodiment.

As illustrated in FIG. 6, the operation lever 6 is rotated about the single bar member 7*b* counterclockwise in the drawing from the state as illustrated in FIG. 4. At this time, based on the principle of leverage, the distance from a fulcrum B as a rotation center of the operation lever 6 to a point of effort C where force is applied to the operation lever 6 is sufficiently longer than the distance from the rotation center of the operation lever 6 (fulcrum B) to a point of action D as the portion 10*a* of the cam 10 that makes contact with the cam follower 18.

The rotation of the operation lever 6 is accompanied by the rotation of the cam 10; then the cam 10 exerts a pushing-up force on the cam follower 18 of the elevating unit 16. This causes the elevating unit 16 to move upward. Thus, the elevating unit 16 moves the roll medium R upward. At this time, the lifting device 2 converts a relatively small force exerted by the user to a larger force by leverage so that the heavy roll medium R can be lifted upward.

Further, the portion 10*a* of the cam 10 that makes contact with the cam follower 18 faces to the movement direction Z of the elevating unit 16. Therefore, the direction to which the cam 10 exerts the force on the cam follower 18 is the movement direction Z of the elevating unit 16. In other words, a force in the lateral direction with respect to the movement direction Z of the elevating unit 16 is not exerted. Accordingly, friction resistance between the elevating unit 16 and the base unit 8 can be made unlimitedly small. As a result, loss of force can be minimized so that the roll medium R is easily lifted up.

It is to be noted that the cam 10 performs rotary motion, whereas the cam follower 18 performs linear motion. Accordingly, friction is generated between the cam 10 and the cam follower 18. However, it is possible to remove the influence of the friction almost completely by making the contact portion smooth.

Figure 7:
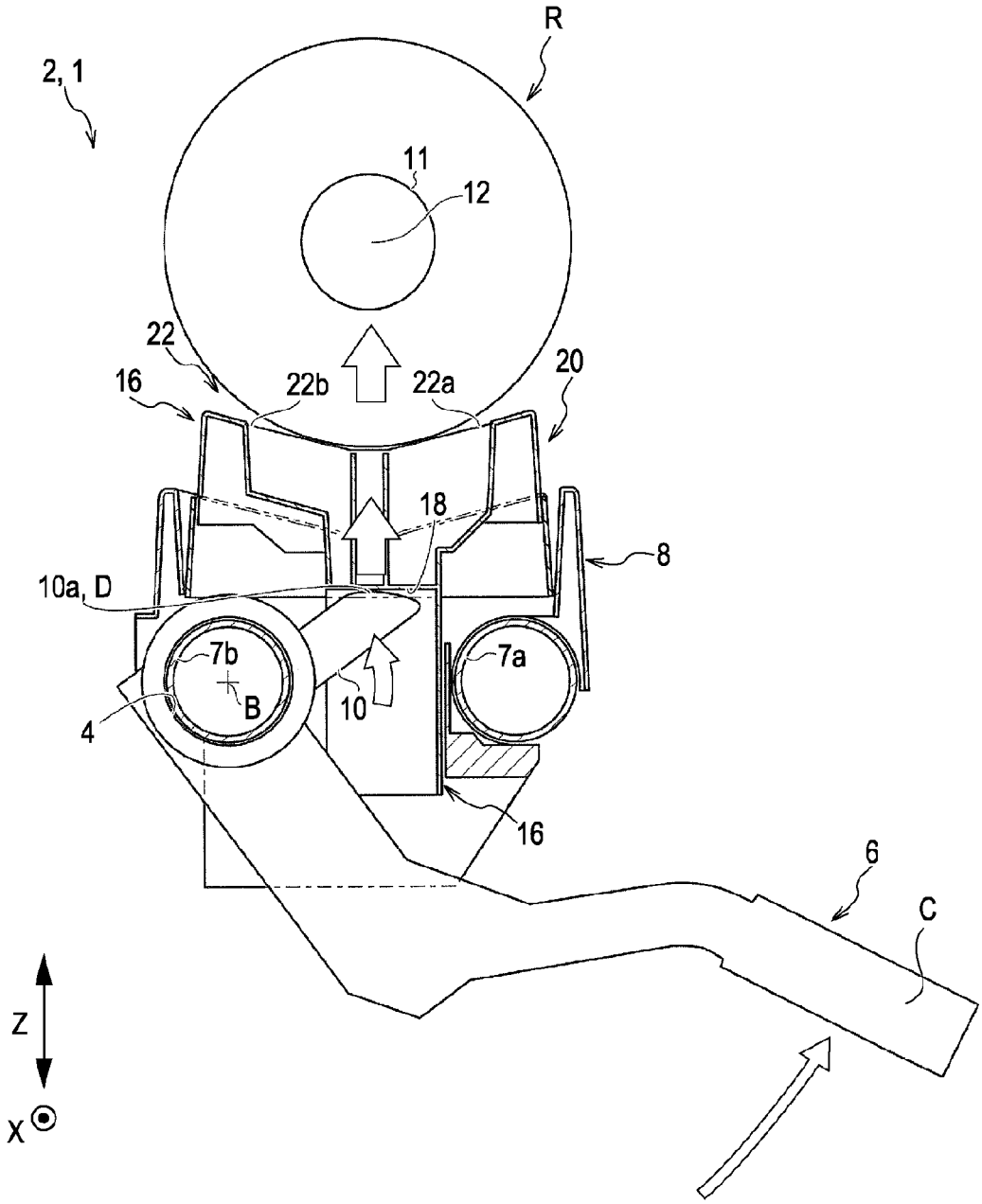
FIG. 7 is another side cross-section view illustrating operation of a lifting device according to an embodiment of the invention (during lifting).

FIG. 7 is another side cross-section view illustrating the operation of lifting during the process of the lifting device 2 according to the embodiment.

As illustrated in FIG. 7, when the operation lever 6 is further rotated counterclockwise in the drawing from the state as illustrated in FIG. 6, the com 10 further rotates. This causes the elevating unit 16 to move further upward. Thus, the elevating unit 16 further lifts up the roll medium R. At this time, the cover member 20 installed at a position between the elevating unit 16 and the base unit 8 makes contact with the elevating unit 16. In this embodiment, the outside surface of the elevating unit 16 and the inside surface of the cover member 20 make contact with each other.

The device may have a configuration in which there is provided a projection or the like so that the cover member 20 and the elevating unit 16 make contact with each other.

In this case, the portion 10*a* of the cam 10 that makes contact with the cam follower 18 also faces to the movement direction Z of the elevating unit 16. Therefore, a force in the lateral direction with respect to the movement direction Z of the elevating unit 16 is not exerted.

Figure 8:
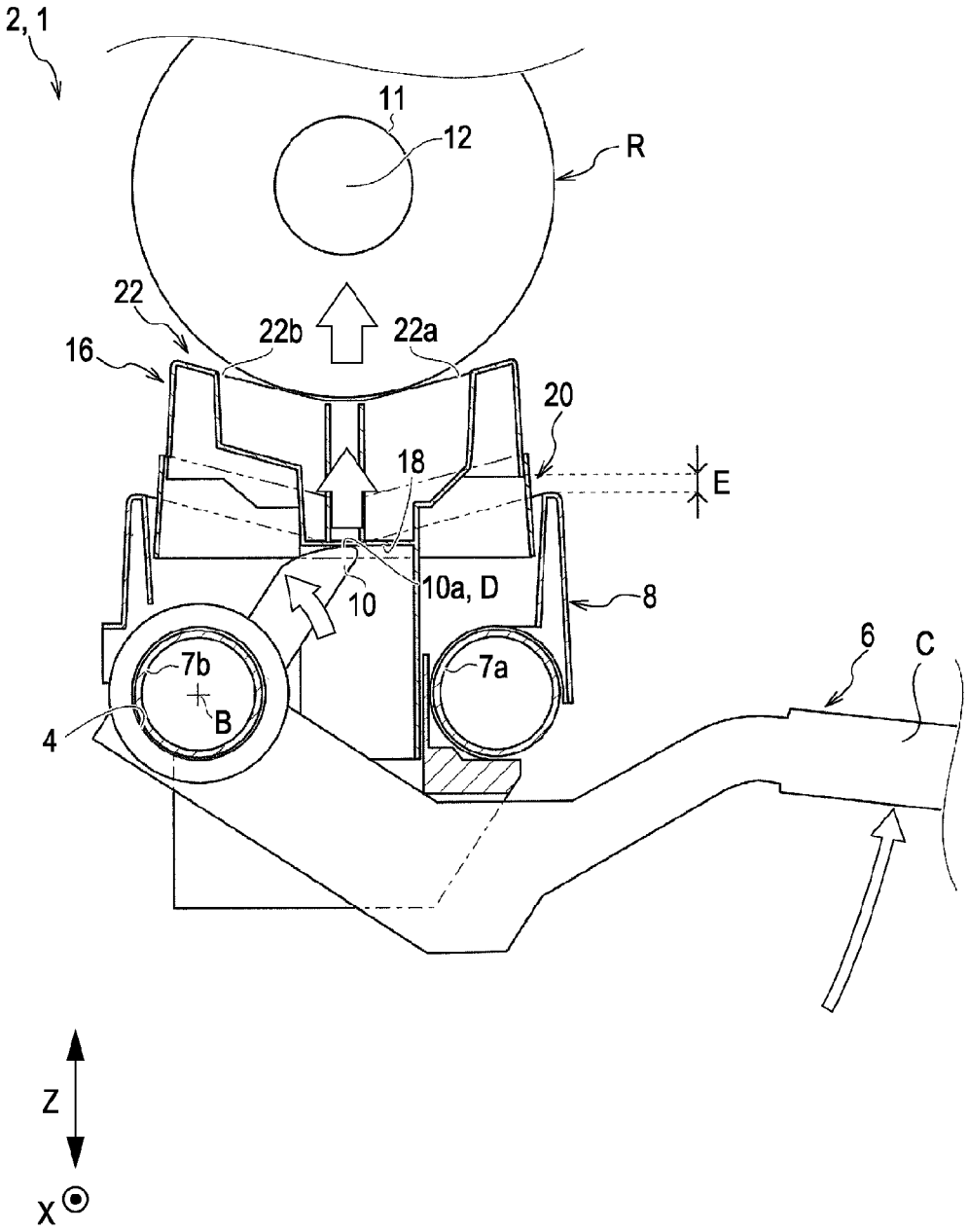
FIG. 8 is a side cross-section view illustrating operation of a lifting device according to an embodiment of the invention (lifting completed).
Figure 9:
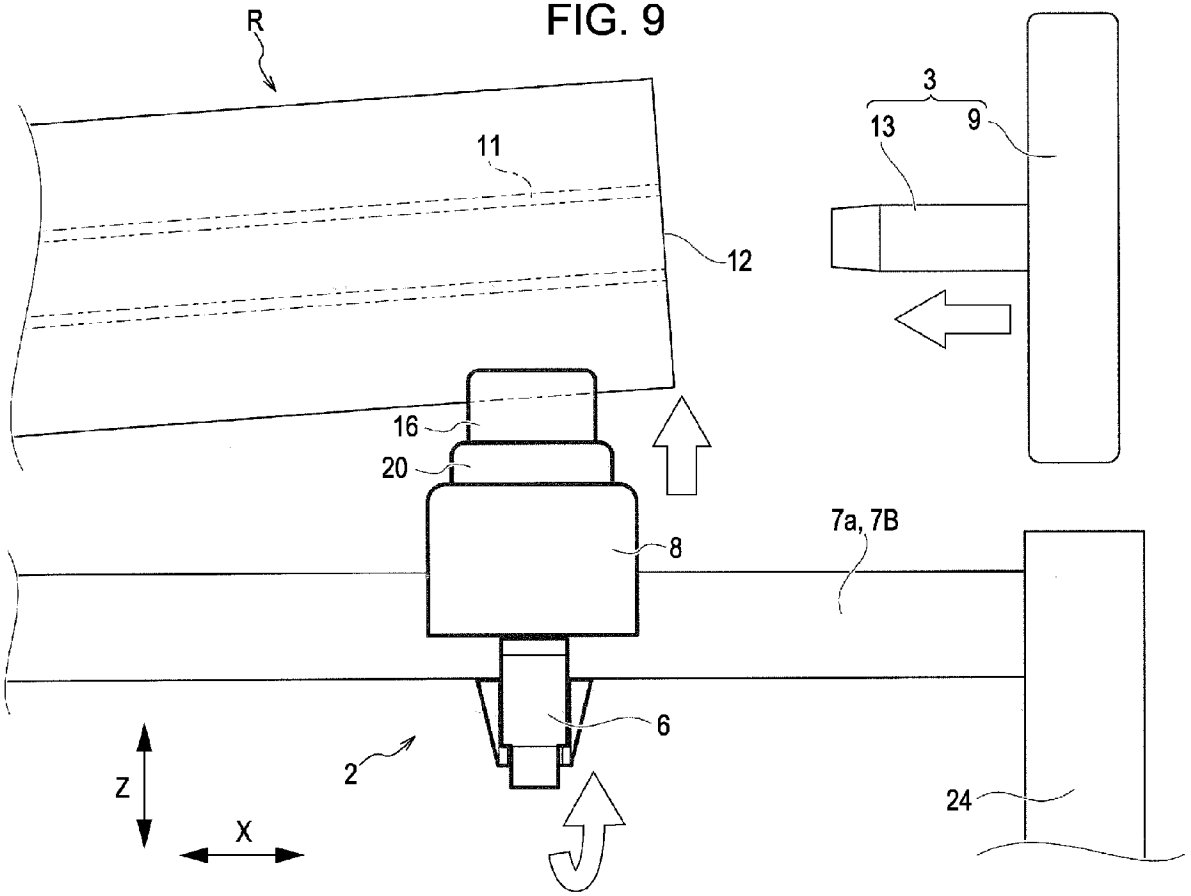
FIG. 9 is an elevation view of the lifting device in the state as illustrated in FIG. 8.

FIG. 8 is a side cross-section view illustrating the lifting device 2 which has completed the operation of lifting; meanwhile, FIG. 9 is an elevation view illustrating the elevation device 2 in the state as illustrated in FIG. 8.

As shown in FIG. 8, when the operation lever 6 is further rotated counterclockwise in the drawing from the state as illustrated in FIG. 7, the cam 10 also further rotates. This causes the elevating unit 16 to move further upward. Thus, the elevating unit 16 further lifts up the roll medium R. At this time, the portion 10*a* of the cam 10 that makes contact with the cam follower 18 also faces to the movement direction Z of the elevating unit 16. Therefore, a force in the lateral direction with respect to the movement direction Z of the elevating unit 16 is not exerted.

Further, at this time, the cover member 20 moves upward with the elevating unit 16. The cover member 20 is so configured as to cover a gap E which is generated between the elevating unit 16 and the base unit 8 by the upward movement of the elevating unit 16. Accordingly, there exists no risk that an object comes into the gap E. In addition, a risk of occurrence of an accident is not present such that a finger is mistakenly got caught in the gap E. In particular, since the gap E is generated when the movement distance of the elevating unit 16 is relatively long, the configuration having the cover member 20 as in this embodiment is effective. Furthermore, since there exists a risk of occurrence of an accident when the roll medium R is heavy in weight, the configuration having the cover member 20 is effective.

Finally, as illustrated in FIG. 9, the rotation of the operation lever 6 is stopped so as to stop the lifting-up of the roll medium R when the core hole 12 of the roll core 11 of the roll medium R has reached the height of the shaft 13 of the first holder unit 3. While being in this state, the shaft 13 is fitted into the core hole 12 by sliding the first holder unit 3. The operation lever 6 can be released when the first holder unit 3 has been fitted to one end side of the roll medium R. Subsequently, the first holder unit 3 is fitted to the other end side of the roll medium R in the same manner.

As described thus far, the portion 10*a* of the cam 10 that makes contact with the cam follower 18 always faces to the direction Z to which the elevating unit 16 moves during the roll medium R being lifted up. Accordingly, as mentioned before, a force in the lateral direction with respect to the direction Z to which the elevating unit 16 moves is not exerted. Consequently, friction resistance between the elevating unit 16 and the base unit 8 can be made unlimitedly small. As a result, loss of force can be minimized so that the roll medium R is easily lifted up.

Further, a portion of the cam follower 18 that makes contact with the cam 10 is constant in position. Therefore, a portion of the elevating unit 16 that receives the force from the cam 10 is always the same. Accordingly, the posture of the elevating unit 16 can be stabilized. It is advisable that the portion mentioned above is positioned directly below the center of gravity of the elevating unit 16, because the posture of the elevating unit 16 can be further stabilized.

Although, in this embodiment, the device is configured so that the portion 10*a* of the cam 10 that makes contact with the cam follower 18 always faces to an upward direction as the direction of lifting-up, the portion 10*a* is not always needed to face to the upward direction. From an engineering standpoint, it is sufficient that the device is configured so that the contact portion 10*a* faces to the upward direction as the direction of lifting-up at the time when the force is largely exerted on the cam follower 18 by the cam 10. For example, the contact portion 10*a* is not needed to face to the upward direction before starting the lifting-up.

Next, operation to lower the roll medium R which has been set on the first holder unit 3 is described.

In the case where the roll medium R which has been once set thereon is used up, only the roll core 11 remains and it will not cause any trouble to directly remove the roll core 11 because it is relatively light in weight. However, for example, before the roll medium R which has been once set is actually used up, it sometimes takes place that the once-set roll medium R is needed to be replaced by the roll medium R of other size, other kind or the like. In such case, the once-set roll medium R, which is heavy in weight, is needed to be detached from the first holder unit 3 and lowered.

In this case, the operation lever 6 is rotated so that the elevating unit 16 is moved upward to receive the roll medium R. To be more specific, the elevating unit 16 is moved up to the position as specified in FIGS. 8 and 9 or to a higher position than that. Then, the first holder unit 3 is slid outside so as to take out the shaft 13 of the first holder unit 3 from the core hole 12 of the roll core 11 of the roll medium R. Thereafter, the operation lever 6 is rotated in the order from the state in FIG. 7 down to the states in FIG. 6 and FIG. 4 so as to move the elevating unit 16 downward. This causes the roll medium R to be lowered. Needless to say, after one end side of the roll medium R is detached, the other end side of the roll medium is detached in the same manner.

Although, in this embodiment, the lifting device 2 is disposed under the first holder unit 3 as the medium transport unit 26, the lifting device 2 may be disposed under the second holder unit 40 as the winding unit 37. In this case, the roll medium R is detached and lowered from the second holder unit 40 and can be gently placed on a predetermined place. The configuration in which the lifting device 2 is disposed under the second holder unit 40 is effective because the wound roll medium R is heavy in weight.

Further, although the embodiment employs the configuration in which the cam 10 provided on the operation lever 6 directly makes contact with the cam follower 18 provided on the elevating unit 16 so as to directly transmit the driving force, the invention is not limited thereto. From an engineering standpoint, the device may have a configuration in which the cam 10 that is provided most downstream in the driving force transmission direction of a driving force transmission unit including gear or the like makes contact with the cam follower 18 of the elevating unit 16 so as to transmit the driving force. Here, it is sufficient that the portion 10*a* of the cam 10 which makes contact with the cam follower 18 faces to the direction in which the elevating unit 16 is moved.

The printer 1 as the recording apparatus according to the embodiment includes: the first holder unit 3 as the roll medium holder having the shaft 13 that holds the roll medium R in a feedable manner; the temporary placement table 5 as the temporary placement unit on which the roll medium R is temporarily placed; and the lifting device 2 as the roll medium lifting device that has the loading unit 22 onto which the roll medium R is loaded, and loads an end portion of the roll medium R, which has been temporarily placed as described above, onto the loading unit 22 and then lifts the roll medium R up to the height of the shaft 13 of the first holder unit 3 so as to be able to align the position of the core hole 12 of the roll core 11 of the roll medium R and the position of the shaft 13. Further, the lifting device 2 includes: the elevating unit 16 that has the loading unit 22 therein and can be raised and lowered in the vertical direction Z; the operation lever 6 that is rotatable about the fulcrum B; and the cam 10 that performs force transmission by converting the rotational movement of the operation lever 6 in the vertical direction Z to the vertical movement of the elevating unit 16 at a position closer to the fulcrum B in the operation lever 6. Furthermore, when the operation lever 6 is rotated to cause the cam 10 to move the elevating unit 16 upward, the portion 10*a* of the cam 10 that makes contact with the elevating unit 16 faces to the movement direction Z when the elevating unit 16 is moved upward.

Further, in the embodiment, the portion 10*a* of the cam 10 that makes contact with the elevating unit 16 is so configured as to face to the movement direction Z of the elevating unit 16, during the time from when the operation lever 6 starts to rotate and the cam 10 makes the elevating unit 16 start to move upward to when the operation lever 6 stops and the elevating unit 16 stops to move upward.

Furthermore, in the embodiment, the elevating unit 16 includes the cam follower 18 as the face that is orthogonal to the movement direction and makes contact with the cam 10, the cam 10 has a curved surface that curves in a convex manner, and the portion of the cam follower 18 that makes contact with the cam 10 is so configured as not to move when the elevating unit 16 is moved.

In addition, the apparatus of this embodiment is so configured as to generate the gap E between the elevating unit 16 and the base unit 8 of the lifting device 2 when the elevating unit 16 is moved upward, and further includes the cover member 20 that covers the gap E by making contact with the elevating unit 16 on the way of the elevating unit 16 moving upward and thereafter moving upward together with the elevating unit 16.

Further, in the embodiment, the temporary placement table 5 includes at least two bar members 7*a*, 7*b* provided in parallel to each other along the width direction X of the roll medium R, the base unit 8 of the lifting device 2 is slidably attached to the bar members 7*a*, 7*b* and configured so as to place temporarily an end portion of the roll medium R thereon, the hole 4 is provided in the operation lever 6, the single bar member 7*b* is inserted into the hole 4, the two bar members 7*a*, 7*b* are inserted into the base unit 8, and the base unit 8 makes contact with the operation lever 6 at both sides in the axial direction (X) of rotation of the operation lever 6 and is so configured as to hold the elevating unit 16 in a slidable manner in the vertical direction Z.

Furthermore, in the embodiment, the loading unit 22 in the elevating unit 16 has two sides 22*a*, 22*b* that make contact with the roll medium R loaded onto the loading unit 22 when viewed from the axial direction (X) of rotation of the operation lever 6, and the distance between the two sides 22*a*, 22*b* becomes shorter as they proceed downward.

The invention is not limited to the aforementioned embodiments and various kinds of variations can be made on the invention without departing from the aspect and the scope of the invention. It is needless to say that such variations on the invention are also included in the scope of the invention.

What is claimed is:

1. A recording apparatus comprising:

a roll medium holder having a first roll medium holder and a second roll medium holder, the first and second roll medium holders holding a roll medium in a feedable manner;

a roll medium lifting device that has a loading unit onto which the roll medium is loaded, and lifts the roll medium; and a supporting unit that supports the roll medium lifting device between the first roll medium holder and the second roll medium holder, wherein the roll medium lifting device includes:

an elevating unit that has the loading unit therein and can be raised and lowered in the vertical direction;

an operation lever that is rotatable about a fulcrum; and a cam that performs force transmission by converting rotational movement of the operation lever in the vertical direction to vertical movement of the elevating unit at a position closer to the fulcrum in the operation lever, wherein when the operation lever is rotated to cause the cam to move the elevating unit upward, a portion of the cam that makes contact with the elevating unit faces to the moving direction when the elevating unit is moved upward.

2. The recording apparatus according to claim 1, wherein the roll medium lifting device includes a base unit which makes contact with the operation lever, wherein the base unit makes contact with the operation lever at both sides in an axial direction of rotation of the operation lever and is so configured as to hold the elevating unit in a slidable manner in the vertical direction.

3. The recording apparatus according to claim 1, wherein a portion of the elevating unit that makes contact with the cam is so configured as not to move in an orthogonal direction which is orthogonal to the movement direction when the elevating unit is moved.

4. The recording apparatus according to claim 1, wherein the recording apparatus is so configured as to generate a gap between the elevating unit and a base unit of the roll medium lifting device when the elevating unit is moved upward; and further includes a cover member that covers the gap by making contact with the elevating unit on the way of the elevating unit moving upward and thereafter moving upward together with the elevating unit.

5. The recording apparatus according to claim 1, wherein the supporting unit includes a bar member that supports the roll medium lifting device, wherein the operation lever includes a hole in which the bar member is inserted, and the operation lever is rotated about the bar as a rotation shaft.

6. The recording apparatus according to claim 1, wherein the loading unit in the elevating unit has two sides that make contact with the roll medium loaded onto the loading unit when viewed from the axial direction of rotation of the operation lever, and the distance between the two sides becomes shorter as the sides proceed downward.

7. A recording apparatus comprising:

a roll medium holder that holds a roll medium in a feedable manner; and a roll medium lifting device that has a loading unit onto which the roll medium is loaded, and lifts the roll medium, wherein the roll medium lifting device includes:

an elevating unit that has the loading unit therein and can be raised and lowered in the vertical direction;

an operation lever that is rotatable about a fulcrum;

a cam that performs force transmission by converting rotational movement of the operation lever in the vertical direction to vertical movement of the elevating unit; and a cover member that covers a gap between the elevating unit and a base unit of the roll medium lifting device when the elevating unit is moved upward.

8. The recording apparatus according to claim 7, wherein the cover member that covers the gap by making contact with the elevating unit on the way of the elevating unit moving upward and thereafter moving upward together with the elevating unit.

* * * * *